US007656260B2

(12) United States Patent
Suzuki et al.

(10) Patent No.: US 7,656,260 B2
(45) Date of Patent: Feb. 2, 2010

(54) WIRE WOUND ELECTRONIC PART

(75) Inventors: Hideharu Suzuki, Gunma (JP); Yoshinari Nakada, Gunma (JP); Takayuki Maruyama, Gunma (JP); Koichi Iguchi, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 12/197,983

(22) Filed: Aug. 25, 2008

(65) Prior Publication Data

US 2009/0058588 A1 Mar. 5, 2009

(30) Foreign Application Priority Data

Sep. 5, 2007 (JP) ..... 2007-230280

(51) Int. Cl.

| | |
|---|---|
| ***H01F 27/29*** | (2006.01) |
| ***H01F 27/02*** | (2006.01) |
| ***H01F 5/00*** | (2006.01) |
| ***H01F 27/28*** | (2006.01) |
| *H01F 7/06* | (2006.01) |

(52) U.S. Cl. ..... 336/192; 336/83; 336/200; 336/232; 29/602.1; 29/605

(58) Field of Classification Search ..... None
See application file for complete search history.

(56) References Cited

U.S. PATENT DOCUMENTS 5,457,872 A * 10/1995 Sakata et al. ..... 29/605
6,100,782 A * 8/2000 Kitagawa et al. ..... 336/192
7,078,988 B2 * 7/2006 Suzuki et al. ..... 333/181
7,477,122 B2 * 1/2009 Iguchi et al. ..... 336/192
2005/0212643 A1 * 9/2005 Kuroiwa et al. ..... 336/200

FOREIGN PATENT DOCUMENTS

JP 03-106005 5/1991
JP 2002-334807 11/2002

* cited by examiner

*Primary Examiner*—Anh T Mai
*Assistant Examiner*—Mangtin Lian
(74) *Attorney, Agent, or Firm*—Law Office of Katsuhiro Arai

(57) ABSTRACT

A wire wound electronic part includes a core having a wire wound core and flanges formed on both ends thereof, a coil conductor wound around the wire wound core and terminal electrodes disposed at the bottom of the flange, in which both ends of the coil conductor are conductively connected to the terminal electrodes by a solder, wherein a pair of grooves are formed at the bottom crossing the wire wound core of one of the flanges. The groove has a bottom and side walls disposed being slanted on both sides thereof, in which the vertical height for the side wall is formed larger than the length for the bottom of the side wall. The terminal electrodes are contained in the groove, and edge portion in the lateral direction of the terminal electrode is restricted by the side wall of the groove. The edge portion in the lateral direction of the terminal electrode is restricted by the side wall of the groove, which makes the lateral size stable and suppresses the movement of the molten solder in the lateral direction of the groove, thereby preventing unstable height and attitude of the wire wound electronic part upon mounting to a circuit substrate.

6 Claims, 6 Drawing Sheets

[Fig. 1]
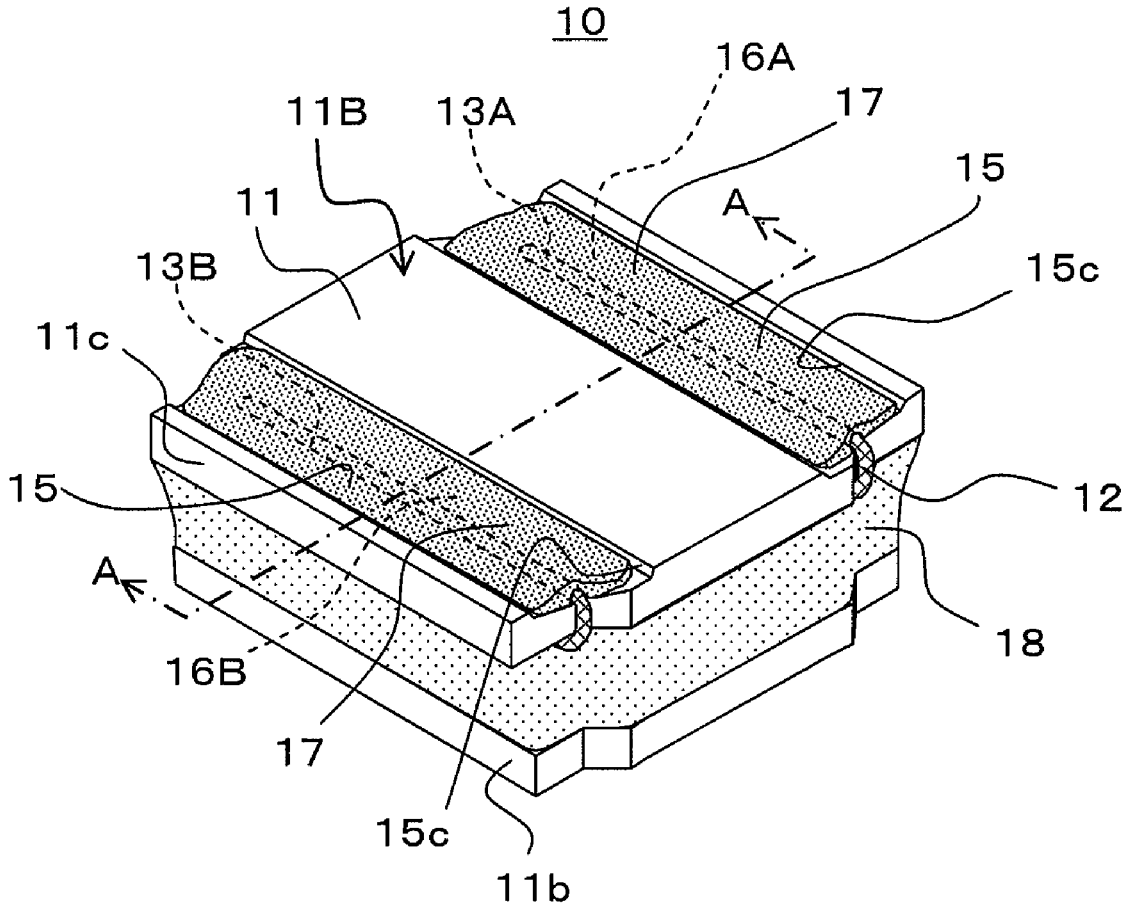

[Fig. 2]
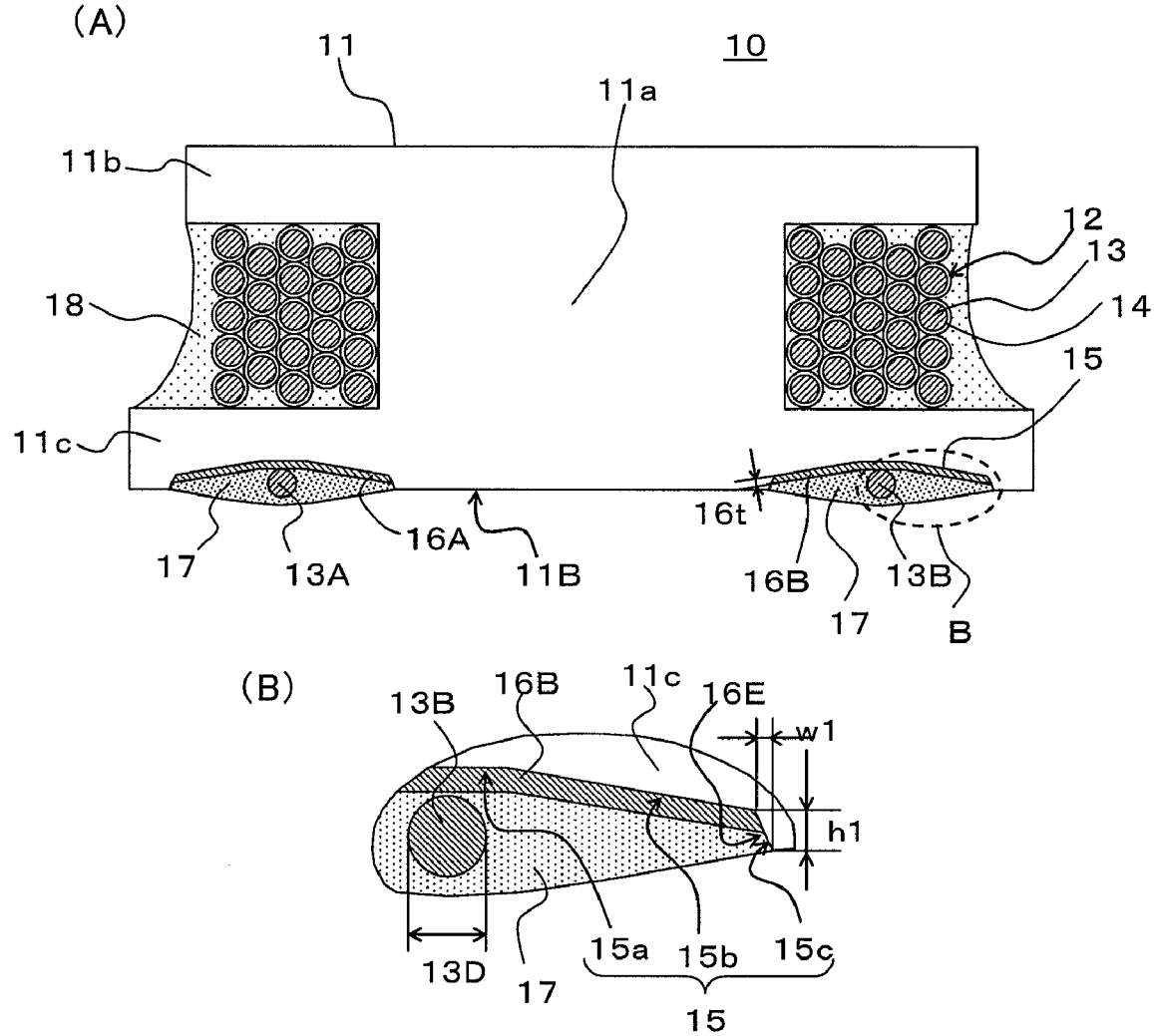

[Fig. 3]
(C)
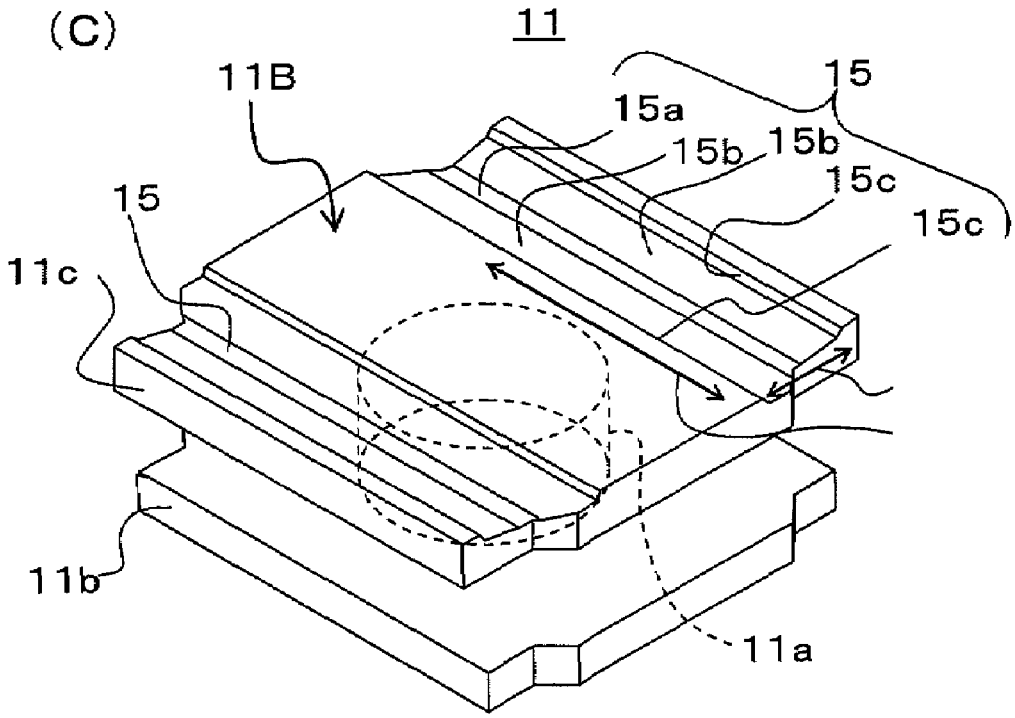
(D)
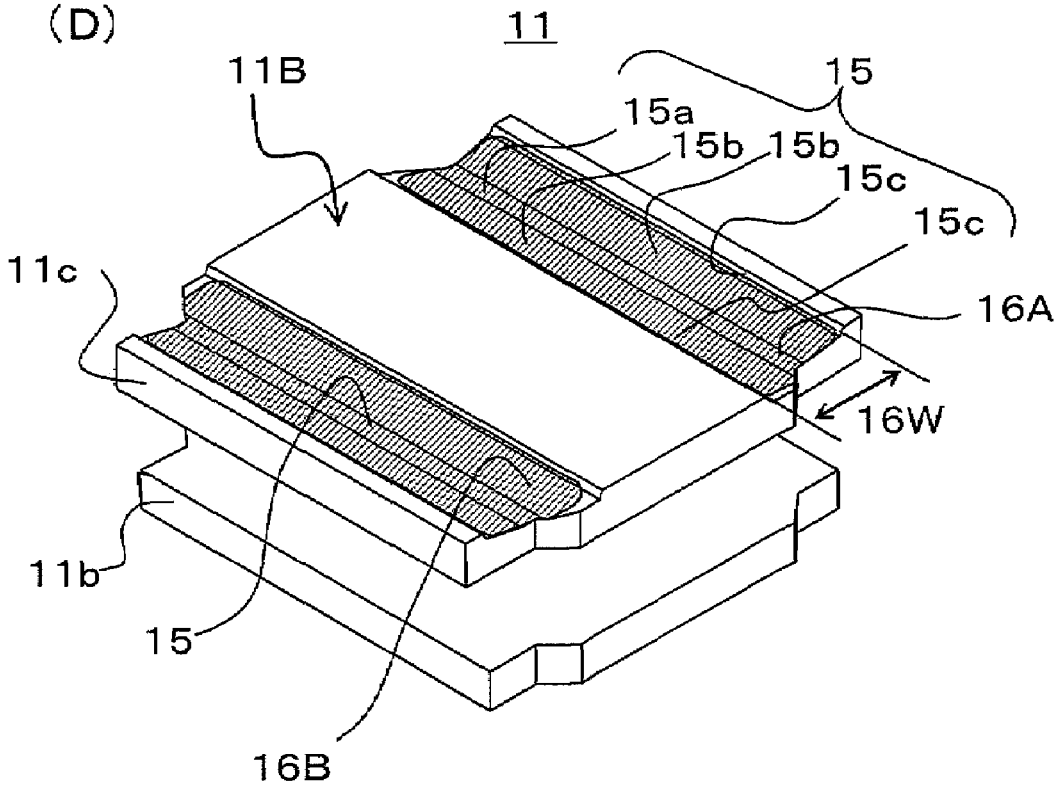

[Fig. 4]
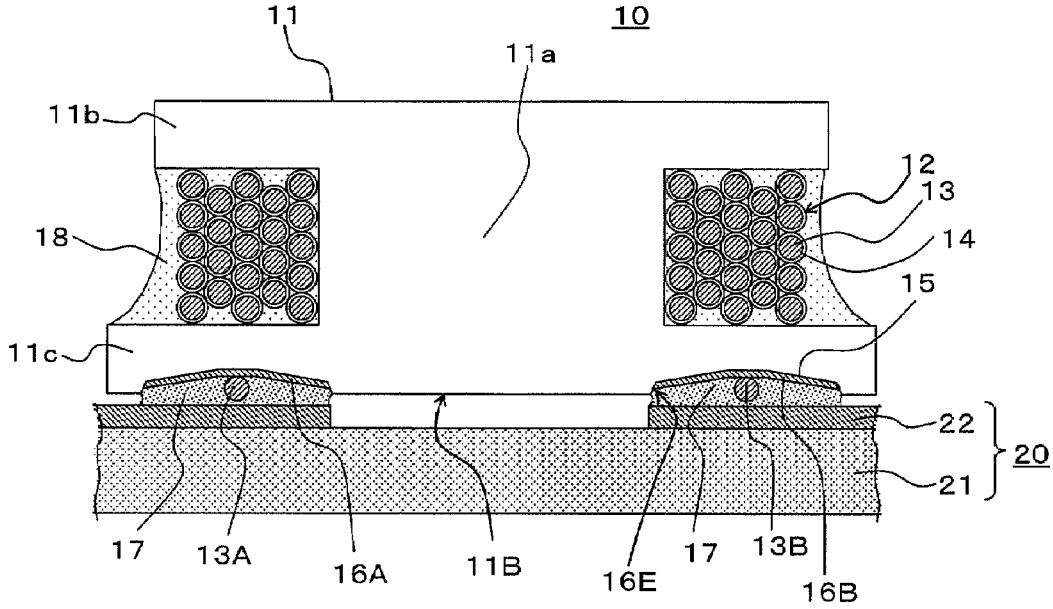
[Fig. 5]
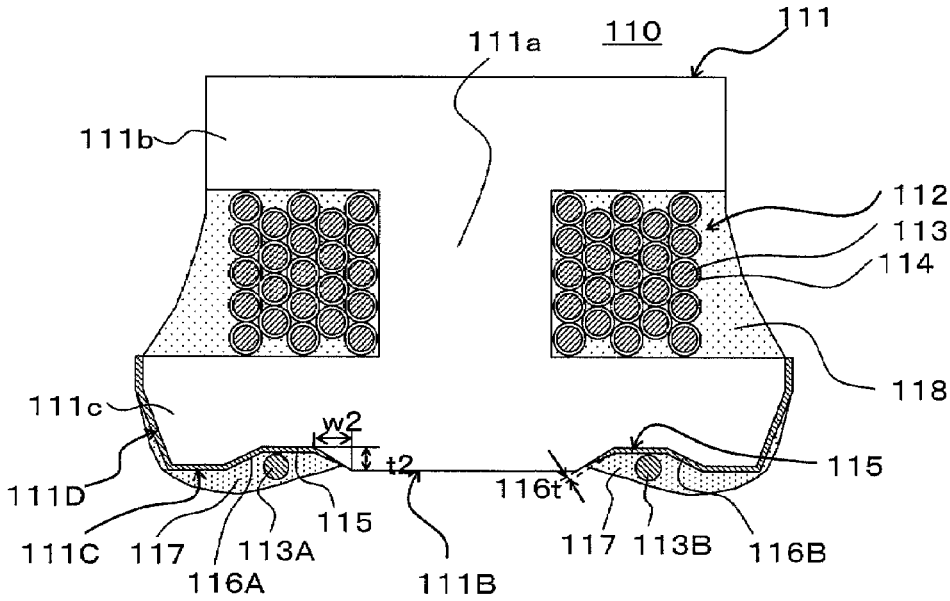
PRIOR ART

[Fig. 6]
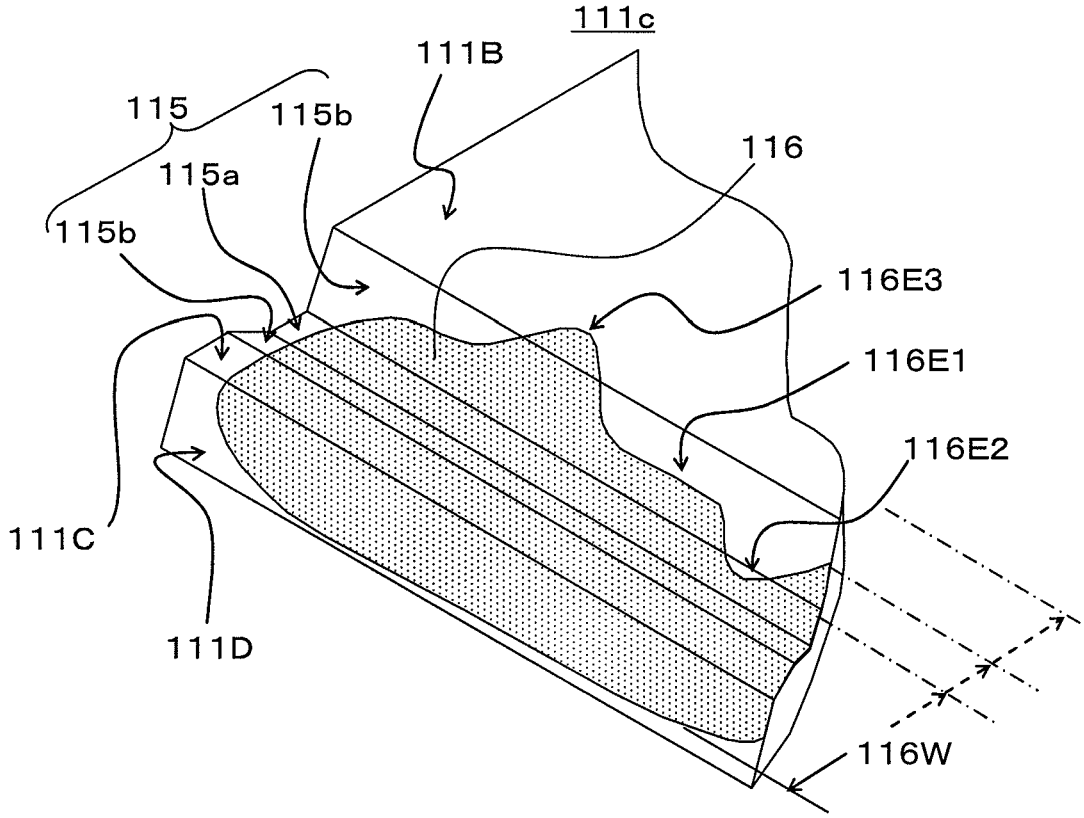
PRIOR ART

[Fig. 7]
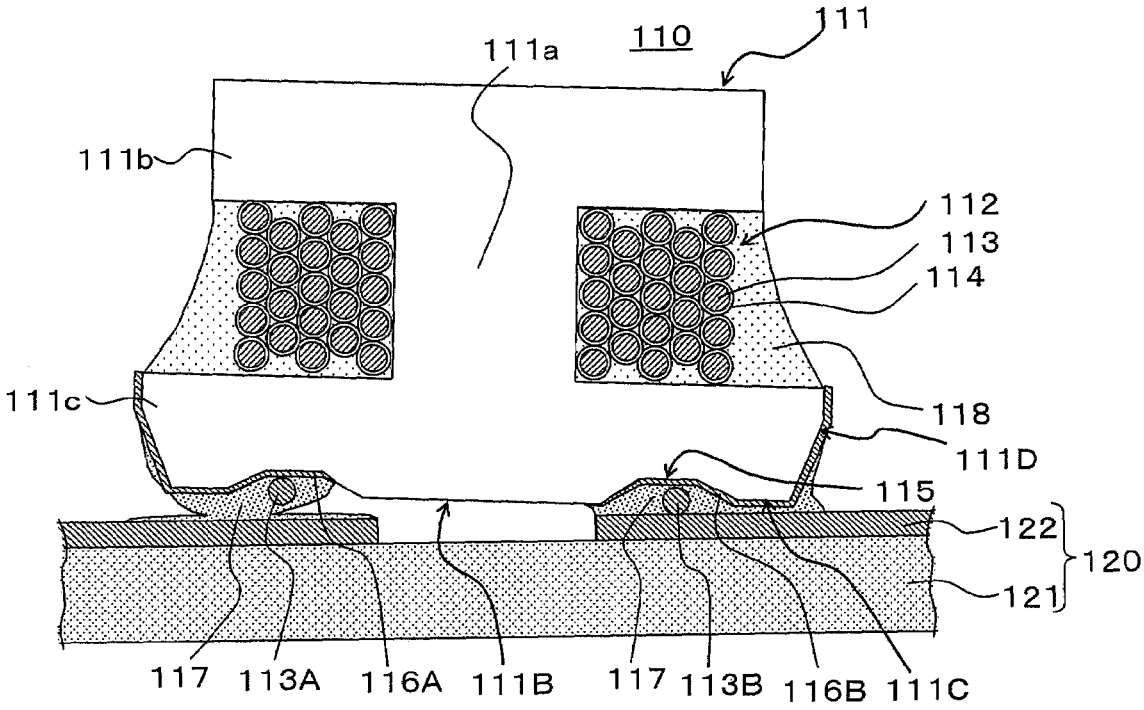
PRIOR ART

WIRE WOUND ELECTRONIC PART

BACKGROUND OF THE INVENTION

1. Field of the Invention

The present invention concerns a wire wound electronic part used, for example, in mobile electronic equipments or thin electronic equipments.

2. Description of the Related Technology

Wire wound type electronic parts are used as step up circuit coils for DC/DC power sources in cellular phones or mobile electronic equipments such as digital still cameras and choke coils in peripheral circuits of various kinds of flat panel displays. For the application uses described above, it is particularly demanded for those having a small and low-profile dimension capable of high density mounting or low-profile mounting while ensuring desired inductor characteristics.

A wire wound electronic part has, for example, a core, terminal electrodes disposed to the core and a coil conductor wound around the core and connected at the ends thereof to the terminal electrodes. The core includes a wire wound core, an upper flange disposed to the upper end of the wire wound core and a lower flange disposed to the lower end of the wire wound core. A pair of the terminal electrodes are formed on the bottom of the lower flange of the core. Further, the coil conductor comprises a metal wire having an insulation coating formed at the outer circumference thereof and is wound around the periphery of the wire wound core of the core. Then, one and the other ends of the coil conductor are removed with the insulation coating and connected to the terminal electrodes respectively by soldering.

Japanese Unexamined Patent Publication No. 2002-334807 discloses a wire wound electronic part 110 as an example of the existent art. FIG. 5 is a vertical cross sectional view taken along a central axis of a wire wound core 111*a* showing the inner structure of the wire wound electronic part 110. FIG. 6 is an enlarged perspective view for a main portion showing a lower flange 111*c* of a core 111 used for the wire wound electronic part 110 as viewed on the side of the bottom 111B. Further, FIG. 7 is a vertical cross sectional view for a main portion showing the state of mounting the wire wound electronic part 110 on a circuit substrate 120.

As shown in FIG. 5 and FIG. 6, it specifically discloses a wire wound electronic part 110 including the core 111 having a columnar wire wound core 111*a* and flanges 111*b*, 111*c* formed at upper and lower ends thereof, a coil conductor 112 wound around the wire wound core 111*a* of the core 111, and terminal electrodes 116A, 116B disposed at a bottom 111B crossing the winding core part 111*a* of the flange 111*c*, in which both ends 113A, 1113B of the coil conductor 112 wound around the wire wound core 111*a* are conductively connected to the terminal electrodes 116A, 116B by using solders 117, 117. Then, a pair of grooves 115 are formed to the bottom 111B of the flange 111*c*, and the groove 115 has a bottom 115*a*, and moderate slopes 115*b*, 115*b* disposed on both lateral sides of the bottom 115*a* being slanted to the bottom 115*a*. Assuming a moderate slope 115*b* as a hypotenuse of a right triangle and defining the same with a length w2 for the bottom and a height in the vertical direction (hereinafter referred to as a vertical height) h2 of the right triangle, the length w2 for the bottom of the moderate slope 115*b* is formed larger than the vertical height h2 for the moderate slope 115*b*. Then, as shown in FIG. 6, the terminal electrode 116 has edge portions 116E1 to 116E3 on one of the moderate slopes 115*b* in the lateral direction of the groove 115 and is formed so as to extend by way of the flat surface 111C of the bottom 111B of the flange 111*c* to the outer lateral surface 111D of the flange 111*c*.

In the existent wire wound electronic part 110, as shown in FIG. 5 and FIG. 6, the terminal electrode 116 decreases the thickness 116*t* as it approaches the edge portions 116E1 to 116E3 of the terminal electrode 116 in the lateral direction of the groove 115, and the position for the edge portions 116E1 to 116E3 of the terminal electrode 116 fluctuates in the lateral direction of the groove 115 on the moderate slope 115*b*. Therefore, the lateral size 116W for the terminal electrode 116 fluctuates depending on the position and is not stable.

Further, as shown in FIG. 7, upon mounting the wire wound electronic part 110 above a circuit substrate 120 in which a mounting land 122 is formed on a substrate 121, when solder 117 put between the flat surface 111C of the bottom 111B and the moderate slope 115*b* of the groove 115 of the flange 111*c*, and the mounting land 122 on the circuit substrate 120 on which the part is mounted is melted, the solder 117 moves in the lateral direction of the groove 115 along the moderate slope 115*b* of the groove 115 and the outer lateral surface 111D of the flange 111*c*.

As described above, the distance between the flat surface 111C of the bottom 111B of the flange 111*c* and the mounting land 122 fluctuates as shown in FIG. 7 by the fluctuation of the lateral size 116W for the terminal electrode 116 and the movement of the molten solder 117 in the lateral direction of the groove 115.

Therefore, this results in a problem that the height and the attitude of the wire wound electronic part 10 becomes instable after mounting to the circuit substrate 120.

SUMMARY OF CERTAIN INVENTIVE ASPECTS

Certain inventive aspects take notice on the problems described above and provide a wire wound electronic part capable of making the height and the attitude stable upon mounting to a circuit substrate.

As a result of an earnest study made by the present inventors for attaining the foregoing purpose, it has been found that fluctuation described above is caused due to the shape of the groove at the bottom of the flange and the region for forming the terminal electrode at the bottom of the flange.

The present invention provides, in a first aspect, a wire wound electronic part including;

a core having a columnar wire wound core, flanges formed at upper and lower ends thereof respectively, and a coil conductor wound around the wire wound core of the core, and terminal electrodes formed at a bottom crossing the wire wound core of the flange, in which both ends of the coil conductor wound around the wire wound core are conductively connected to the terminal electrodes by using a solder, wherein a pair of grooves are formed at the bottom of the flange where the terminal electrodes are disposed, the groove has a bottom and side walls disposed on both lateral sides of the bottom being slanted to the bottom and, when assuming the side wall as a hypotenuse of a right triangle and defining the same with a length for the bottom and the height in the vertical direction (vertical height) of the right triangle, the vertical height of the side wall is formed larger than the length for the bottom, the terminal electrodes are contained in the groove, and the edge portion of the terminal electrode in the lateral direction is restricted by the side wall of the groove.

Then, upon mounting to the circuit substrate, movement of the molten solder in the lateral direction of the groove is restricted by the side wall and the solder moves in the longitudinal direction of the groove.

As described above, the terminal electrode is restricted at the edge portion in the lateral direction by the side wall of the groove and the lateral size thereof is made stable, and the movement of the molten solder in the lateral direction of the groove is restricted.

Therefore, the size in the height and the attitude of the wire wound electronic part can be made stable upon mounting.

Further, the invention provides, in a second aspect according to the first aspect, a wire wound electronic part, wherein the groove has a moderate slope between the bottom and the side wall and, when assuming the moderate slope as a hypotenuse of a right triangle and defining the same with a length for the bottom and the height in the vertical direction (vertical direction) of the right triangle, the length for the bottom of the moderate slope is formed larger than the vertical height of the moderate slope, to form a moderate inclination.

Accordingly, the position for the end of the coil conductor in the groove is specified and the position of the edge portion of the terminal electrode relative to the position for the end of the coil conductor is restricted by the side wall.

Further, the invention provides in a third aspect according to the first aspect, a wire wound electronic part, wherein the vertical height of the side wall is larger than the thickness of the terminal electrode.

Accordingly, the position for the edge portion of the terminal electrode is reliably restricted by the side wall. Further, movement of the molten solder in the lateral direction of the groove is hindered by the side wall of the groove exposed from the terminal electrode.

Further, the invention provides in a fourth aspect according to the first aspect, a wire wound electronic part, wherein the length for the bottom of the side wall is smaller than the diameter at the end of the coil conductor.

Therefore, a distance from the center of the coil conductor to the edge portion of the terminal electrode in the lateral direction is restricted more reliably to suppress fluctuation of the lateral size of the terminal electrode.

Further, the invention provides, in a fifth aspect according to the first aspect, a wire wound electronic part, wherein the terminal electrode is a thick film electrode formed by a transfer method.

Accordingly, the terminal electrode has a relatively uniform thickness as far as the vicinity of the edge portion of the terminal electrode from the bottom by way of the moderate slope to the base end of the side wall in contact with the moderate slope of the groove, and has a stable lateral size being restricted for the position of the lateral edge portion by the side wall of the groove.

BRIEF DESCRIPTION OF THE DRAWINGS

The foregoing and other objects, features, functions, and effects of certain inventive aspects will become apparent from the following descriptions taken in connection with the accompanying drawings, wherein FIG. 1 is a perspective view for the appearance showing the entire structure of a first embodiment of a wire wound electronic part;

FIG. 2 is a vertical cross sectional view showing the inner structure of a wire wound electronic part of the first embodiment;

FIG. 3 is a perspective view for the appearance showing the entire structure of a core used for the wire wound electronic part of the first embodiment;

FIG. 4 is a vertical cross sectional view showing the state of mounting the wire wound electronic part of the first embodiment above a circuit substrate;

FIG. 5 is a vertical cross sectional view showing an example of a wire wound electronic part in the existent art;

FIG. 6 is an enlarged perspective view for a main portion showing the bottom side of a lower flange as an example of a wire wound electronic part in the existent art; and FIG. 7 is a vertical cross sectional view of a main portion showing the state of mounting an example of the wire wound electronic part in the existent art above a circuit substrate.

DETAILED DESCRIPTION OF CERTAIN INVENTIVE EMBODIMENTS

A first embodiment of a wire wound electronic part is to be described with reference to FIG. 1 to FIG. 4. FIG. 1 is a perspective view for the appearance for explaining the entire structure of a wire wound electronic part 10 of a first embodiment as viewed on the side of a bottom 11B having a pair of terminal electrodes 16A, 16B. FIG. 2 is view for explaining the internal structure of the wire wound electronic part 10 of this embodiment in which FIG. 2A is a vertical cross sectional view taken along a central axis of a wire wound core 11*a* of the wire wound electronic part 10 and FIG. 2B is an enlarged cross sectional view showing a region surrounded by a broken line B in FIG. 2A for the wire wound electronic part 10. FIG. 3 is a view for explaining a core 11 used for the wire wound electronic part 10 of this embodiment in which FIG. 3C is a perspective view for the appearance of the core 11 as viewed on the side of the bottom 11B of the lower flange 11*c* and FIG. 3D is a perspective view for the appearance of the core 11 after forming the pair of terminal electrodes 16A, 16B as viewed on the side of the lower flange 11*c*. FIG. 4 is a vertical cross sectional view for a main portion showing the state of mounting the wire wound electronic part 10 above a circuit substrate 20 in which a mounting land 22 is formed on one main surface of a substrate 21.

As shown in FIG. 1 to FIG. 4, the wire wound electronic part 10 of this embodiment includes the core 11 comprising a soft magnetic material, a coil conductor 12 wound around the core 11, and a pair of terminal electrodes 16A, 16B connected with ends 13A, 13B of the coil conductor 12, in which a magnetic powder-containing resin 18 is further coated for covering the wound coil conductors 12.

More specifically, as shown in FIG. 3C, the core 11 includes a columnar wire wound core 11*a*, an upper flange 11*b* disposed at the upper end of the wire wound core 11*a* and a lower flange 11*c* disposed to the lower end of the wire wound core 11*a*. Then, a pair of grooves 15, 15 are formed to the bottom 11B crossing the central axis of the wire wound core 11*a* of the lower flange 11*c* of the core 11 while putting therebetween an extension line from the central axis of the wire wound core 11*a*.

The grooves 15, 15 include, respectively, as shown in FIG. 2B, a bottom 15*a*, side walls 15*c*, 15*c* on both lateral sides of the bottom 15*a* being slanted to the bottom 15*a*, and moderate slopes 15*b*, 15*b* disposed between the bottom 15*a* and the side walls 15*c*, 15*c*.

When assuming the side wall 15*c* as a hypotenuse of a right triangle and defining the same with a length w1 for the bottom and a height in the vertical direction (vertical height) h1 of the right triangle, the vertical height h1 for the side wall 15*c* is formed larger than the length w1 for the bottom of the side wall 15*c*.

When assuming the moderate slope 15*b* as a hypotenuse of a right triangle and defining the same with a length for the bottom and the height in the vertical direction (vertical height) of the right triangle, the length for the bottom of the moderate slope is formed larger than the vertical height of the moderate slope.

Further, the pair of terminal electrodes 16A, 16B are contained for all the regions from one end to the other end in the lateral direction within the grooves 15, 15. Then, the edge portions 16E in the lateral direction of the terminal electrodes 16A, 16B are restricted by the side walls 15*c*, 15*c* of the groove 15.

Further, the coil conductor 12 comprises a metal wire 13 having an insulation coating 14 being formed at the outer periphery thereof and is wound around the periphery of the columnar wire wound core 11*a* of the core 11, and connected by solders 17, 17 to the terminal electrodes 16A, 16B respectively in a state where the insulation coating 14 is removed at one and the other ends 13A, 13B.

Then, as shown in FIG. 4, upon mounting of the wire wound electronic part 10 to the circuit substrate 20, the molten solder 17 is restricted for the movement in the lateral direction of the groove 15 by the side walls 15*c*, 15*c* and moves in the longitudinal direction of the groove 15.

As described above, the terminal electrodes 16A, 16B are restricted at the edge portions 16E in the lateral direction by the side walls 15*c*, 15*c* of the grooves 15, 15 and are stabilized for the lateral size 16W, and the movement of the molten solder 17 in the lateral direction of the grooves 15, 15 is suppressed. Accordingly, the height and the attitude of the wire wound electronic part 10 are made stable upon mounting to the circuit substrate 20.

Further, in the wire wound electronic part 10 of this embodiment, in addition to the constitution described above, the vertical height h1 of the side wall 15*c* is larger than the thickness 16*t* of the terminal electrodes 16A, 16B. Accordingly, the positions for the edge portions 16E of the terminal electrodes 16A, 16B are restricted reliably by the side walls 15*c*, 15*c*. Further, movement of the molten solver 17 in the lateral direction of the groove 15 is hindered by the side walls 15*c*, 15*c* of the groove 15 exposed from the terminal electrodes 16A, 16B.

Further, in the wire wound electronic part 10 of this embodiment, in addition to the constitution described above, the length w1 for the bottom of the side wall 15*c* is smaller than the diameter 13D at the ends 13A, 13B of the coil conductor 12. Accordingly, the distance from the center of the coil conductor 12 to the edge portion in the lateral direction of the terminal electrodes 16A, 16B is restricted more reliably and fluctuation of the lateral size 16W for the terminal electrodes 16A, 16B is suppressed.

Further, in the wire wound electronic part 10 of this embodiment, in addition to the constitution described above, the terminal electrodes 16A, 16B are thick film electrodes formed by a transfer method. Accordingly, the terminal electrodes 16A, 16B have a relatively uniform thickness as far as the vicinity for the edge portions 16E of the terminal electrodes 16A, 16B, from the bottom 15*a* along the moderate slope 15*b* to the base end of the side wall 15*c* in contact with the moderate slope 15*b* of the groove 15, and have a stable lateral size 16W with the position for the edge portion 16E in the lateral direction being restricted by the side walls 15*c*, 15*c* of the groove 15.

A preferred embodiment for the core 11 is as described below. That is, the core 11 preferably comprises a soft magnetic material, for which a high permeability magnetic material comprising Ni—Zn type ferrite, particularly, Ni—Zn—Cu type ferrite as a main ingredient is more preferred. After mixing a powder of the magnetic material and a binder and pelleting them, a square columnar molding product is formed by using a powder molding press, and a recess is formed by centerless grinding using a grinding disk to obtain a drum-shaped molding product. Then, after applying a debinding treatment to the obtained drum-shaped molding product at about 800° C., it is baked at a predetermined temperature depending on the sintering temperature of the magnetic material to obtain the core 11.

Further, the method of forming the drum-shaped molding product is not restricted to the method of forming a recess to the peripheral lateral surface of the square columnar molding product by centerless grinding but it can be obtained also by pelletting in the same manner as described above and then by dry one-piece molding using a powder molding press. Further, the method of obtaining the core is not restricted to the method of previously providing a drum shaped molding product and baking the same, but it may be formed by a method, for example, of providing a square columnar molding product in the same manner, then applying the debinding treatment in the same manner as described above, baking at a predetermined temperature, and then forming a recess by grinding fabrication to the peripheral lateral surface of the square columnar sintered magnetic product by using a diamond wheel or the like.

The wire wound core 11*a* of the core 11 preferably has a substantially circular or circular cross sectional shape such that the length of the coil conductor 12 necessary for obtaining a predetermined number of turns can be made shorter, but this is not restrictive and it may be changed properly while considering the durability of the molding die or easy deburring, particularly, in a case of manufacture by a method of obtaining a drum shaped molding product by dry one-piece molding.

Preferably, the outer shape of the lower flange 11*c* of the core 11 is substantially square shape or a square shape in a plan view for size-reduction corresponding to high density mounting, but this is not restrictive and it may be a polygonal or substantially circular shape. Further, the outer shape for the upper flange 11*b* of the core 11 preferably has a shape similar with the lower flange 11*c* or preferably has a size equal with that of the lower flange 11*c* and a size somewhat smaller than the lower flange portion 11*c* for decreasing the size corresponding to high density mounting. Further, four corners of the upper flange 11*b* are preferably chamfered for facilitating filling of the magnetic powder-containing resin 18 between the upper flange 11*b* and the lower flange 11*c*.

Further, the thickness for the upper flange 11*b* and the lower flange 11*c* is preferably 0.5 mm or less respectively for providing a low-profile wire wound electronic part 10. On the other hand, the lower limit for the thickness of the upper flange 11*b* and the lower flange 11*c* is preferably set so as to satisfy a predetermined strength while considering the protruding size of the upper flange 11*b* and the lower flange 11*c* respectively from the wire wound core 11*a* of the core 11.

A preferred embodiment for the grooves 15, 15 is as described below. That is, the grooves 15, 15 are preferably formed at least by one pair to the bottom 11B of the lower flange 11*c* of the core 11. Further, the grooves 15, 15 are preferably formed by at least one pair so as to put therebetween an extension line from the central axis of the wire wound core 11*a*.

For the depth of the grooves 15, 15, they are preferably formed such that a portion of the diameter 13D at the ends 13A, 13B of the coil conductor 12 protrudes from the groove 15 exceeding the position for the height on the flat surface of the bottom 11B in a state where the terminal electrodes 16A, 16B are formed on the bottom 15*a* of the groove 15.

Further, both ends of the grooves 15, 15 in the longitudinal direction preferably reach a pair of outer lateral surfaces of the lower flange 11*c* opposed to each other. This facilitates the movement of the molten solder 17 in the longitudinal direction of the groove 15.

Further, the grooves 15, 15 preferably have bottoms 15*a*, 15*a* which situate substantially at the center in the lateral direction of the grooves 15, 15 and are substantially in parallel with the bottom 11B of the lower flange 11*c*, and side walls 15*c*, 15*c* disposed on both lateral sides of the bottom 15*a* and disposed being slanted to the bottom 15*a*.

Further, the grooves 15, 15 preferably have moderate slopes 15*b*, 15*b* between the bottoms 15*a* and the side walls 15*c*, 15*c*. When assuming the moderate slope 15*b* as a hypotenuse of a right triangle and defining the same with a length for the bottom and the height in the vertical direction (vertical height) of the right triangle, the length for the bottom of the moderate slope 15*b* is preferably larger than the vertical height of the moderate slope.

Further, the method of forming the groove 15 to the bottom 11B may include a method of previously providing a pair of ridges to a surface of a pressing die upon forming the square columnar molding product and forming the groove simultaneously with the molding of the molding product in the step of manufacturing the core 11, as well as a pair of grooves may be formed, for example, by applying a cutting fabrication to the surface of the obtained square columnar molding product.

Then, a preferred embodiment for the side wall 11*c* of the groove 15 is as described below. That is, assuming the side wall 15*c* of the groove 15 as a hypotenuse of a right triangle and defining the same with the length for the bottom and the height in the vertical direction (vertical height) of the right triangle, the vertical height h1 for the side wall 15*c* is preferably larger than the length w1 for the side wall 15*c*.

Further, the vertical height h1 for the side walls 15*c*, 15*c* is preferably larger than the thickness for the terminal electrodes 16A, 16B to be described later.

Further, the length w1 for the bottom of the side walls 15*c*, 15*c* is preferably smaller than the diameter 13D at the ends 13A, 13B of the coil conductor 12 to be described later.

A preferred embodiment for the terminal electrodes 16A, 16B is as described below. That is, the terminal electrodes 16A, 16B preferably comprise each a thick film formed by coating a baking type electrode material paste comprising a glass flit containing a Cu powder or a Ag powder and boron and zinc as a main ingredient to the bottom 11B of the lower flange 11*c* of the core 11 and then applying a heat treatment to the obtained core.

The thickness 16*t* of the terminal electrodes 16A, 16B is preferably smaller than the vertical height h1 for the side wall 15*c* of the groove 15.

The method of forming the terminal electrodes 16A, 16B may include a transfer method such as a roller transfer method or a pad transfer method and a printing method such as a screen printing method or a stencil printing method, as well as a spray method, an ink jet method or the like. Among them, the transfer method is more preferred for forming a terminal electrode of a stable lateral size which is contained in the groove 15 with the edge portion 16E being restricted by the side wall 15*c*.

In the explanation described above, "contained in the groove 15" means a state in which the edge portion 16E in the lateral direction of the terminal electrodes 16A, 16B does not exceed the end of the side wall 15*c* of the groove on the side of the bottom 11B.

Further, in the explanation described above, "restricted by the side wall 15*c*" means a state that the edge portion 16E in the lateral direction of the terminal electrodes 16A, 16B reaches at least a position above the side wall 15*c* except for the vicinity of both ends in the longitudinal direction, and the edge portion 16E in the lateral direction does not override the end of the side wall 15*c* on the side of the bottom 11B.

Then, a preferred embodiment of the coil conductor 12 is as described below. That is, the coil conductor 12 is preferably wound around the periphery of the wire wound core 11*a* of the core 11 and has an insulation coating 14 comprising a polyurethane resin or a polyester resin at the outer periphery of the metal wire 13.

Further, the metal wire 13 for the coil conductor 12 is not restricted to a single wire but may also be a twisted wire. Further, the cross sectional shape of the metal wire 13 of the coil conductor 12 is not restricted to the circular shape but a flat wire of a rectangular cross sectional shape or a square wire of a square cross sectional shape may also be used.

The diameter 13D at the ends 13A, 13B of the coil conductor 12 is preferably larger than the length w1 for the bottom of the side wall 15*c* of the groove 15.

In the foregoings, "conductive connection by using the solder" is not restricted to conductive connection using only the solder but may be any connection so long as a portion where the terminal electrodes 16A and 16B and the ends 13A, 13B of the coil conductor 12 are connected conductively by way of the solder is present. For example, it may be such a structure that the terminal electrodes 16A, 16B and the ends 13A, 13B of the coil conductor 12 have a portion bonded by inter-metal bonding by hot press bonding and coated with the solder so as to cover the bonded portion.

A preferred embodiment of the magnetic powder-containing resin 18 is as described below. That is, as the magnetic powder-containing resin 18, those having a viscoelasticity within a range of working temperature of the wire wound electronic part 10 are preferred. More specifically, a magnetic powder-containing resin having a glass transition temperature of about −20° C. or lower in the course of transition from a glassy state to a rubbery state upon change of the modulus of rigidity to the temperature as the physical property during curing is preferred. A magnetic powder-containing resin having a glass transition temperature of about −50° C. or lower in the course of transition from the glassy state to the rubbery state upon change of the modulus of rigidity to the temperature as the physical property during curing is more preferred. As the resin used for the magnetic powder-containing resin 18, a silicone resin is preferred, and a resin mixture of an epoxy resin and a carboxyl group-modified propylene glycol is more preferred since the lead time for the step of intruding the magnetic powder-containing resin 18 between the flanges 12, 13 can be shortened.

Then, as the magnetic powder used for the magnetic powder-containing resin 18, various kinds of magnetic powders can be used. Specifically, one member or a mixture of plurality of members selected from the powder of Ni—Zn type ferrite, the powder of Ni—Zn—Cu type ferrite, the powder of Mn—Zn type ferrite, metal magnetic powder, etc. may be used preferably. The grain size of the magnetic powder is preferably from about 5 to 20 μm. The content of the magnetic powder in the magnetic powder-containing resin 18 is preferably from about 30 to 85 wt %.

As a method of coating the magnetic powder-containing resin 18 on the outer periphery of the coil conductor 12 in a region wound around the periphery of the wire wound core 11*a* of the core 11, it is preferred, for example, to discharge a paste of the magnetic powder containing resin 18 on the outer periphery of the coil conductor 12 by a dispenser and harden the same.

Example

At first, a commercially available polyurethane-coated coil conductor 12 in which an insulation coating 14 comprising a polyurethane resin of 6 μm thickness is formed at the outer periphery of a metal wire 13 comprising Cu having a circular cross sectional shape of 85 μm diameter is prepared.

Further, as a core 11, a powder of Ni—Zn—Cu type ferrite is used as the magnetic material, which is mixed with an organic binder for powder molding to prepare a square columnar molding product, a recess is formed to the peripheral lateral surface of the molding product using a grinding wheel and, after applying a debinder treatment at 800° C., it is baked at 1050° C. to prepare a square core 11 having an outer dimension of 4.0 mm square and a thickness of 0.3 mm for an upper flange and a lower flange respectively, a height of 0.4 mm for the wire wound core and a diameter of 2.0 mm for the wire wound core.

A pair of grooves 15, 15 are formed so as to put therebetween an extension line from the central axis of the wire wound core 11*a* at the bottom 11B of the lower flange 11*c* of the obtained core 11. Referring to the dimension of the groove 15, the width is 0.2 mm for the deepest bottom 15*a*, the length for the bottom is 0.3 mm and the height in the vertical direction (vertical height) is 0.1 mm for the moderate slope 15*b*, 15*b* disposed on both sides of the bottom 15*a* respectively, the length w1 for the bottom is 0.02 mm and the height in the vertical direction (vertical height) h1 is 0.05 mm for the side walls 15*c*, 15*c* disposed on both sides in the lateral direction of the groove 15. Both ends in the longitudinal direction of the groove 15 reach a pair of outer lateral surfaces of the lower flange 11*c* opposing to each other, respectively.

Then, a Cu electrode paste is coated to the groove 15 for a width in contact with the side walls 15*c*, 15*c* on both sides in the lateral direction of the groove 15 by a roller transfer method, and baked in an $N_2$ gas atmosphere at a predetermined temperature to form a pair of terminal electrodes 16A, 16B. In this case, the edge portions 16E in the lateral direction of the terminal electrodes 16A, 16B are restricted within such a range as reaching the side walls 15*c*, 15*c* on both sides in the lateral direction of the groove 15 respectively but not overriding the end of the side wall 15*c* on the side of the bottom 11B.

For the core 11 obtained as described above by the number of 100, when the maximum lateral size 16W of the terminal electrodes 16A, 16B projected respectively on a horizontal plane is measured by using a measure scope manufactured by Nicon Corp., the minimum value is 0.825 mm, the maximum value is 0.840 mm, and the range of fluctuation is 0.015 mm.

Then, a solder paste containing a flux is previously coated by a stencil printing method on the terminal electrodes 16A, 16B, the coil conductor 12 is wound around by 10 turns to the periphery of the wire wound core 11*a* of the core 11, and the insulation coating 14 on both ends of the coil conductor 12 is peeled by using a film peeling solvent DEPAINT (registered trade mark) KX manufactured by Sanei Kagaku Co., Ltd. Then, one end 13A and the other end 13B of the coil conductor 12 are pressed to the terminal electrodes 16A, 16B coated with the solder paste respectively by a soldering iron heated to 240° C. and conductively connected by using a solder.

Then, a magnetic powder-containing a resin paste is prepared by mixing 50% by weight of an Mn—Zn type ferrite powder, 5% by weight of a curing agent, and 10% by weight of a solvent to a resin formed by mixing an epoxy resin and a carboxyl group-modified propylene glycol at a 50:50 weight ratio, and discharged between the upper flange 11*b* and the lower flange 11*c* at the outer periphery of the coil conductor 12 for a wound region in the wire wound electronic part 10 of the embodiment described above by using a dispenser and cured by heating at 150° C. for one hour to obtain a wire wound electronic part 10.

After printing a cream solder on a circuit substrate 20 in which a mounting land 22 comprising a copper foil is formed on a glass-epoxy substrate 21, wire wound electronic parts 10 of the example described above are mounted by the number of 100, and applied with reflow soldering at 245° C. to conduct mounting. After measuring the height of the wire wound electronic part 10 on the obtained wire wound electronic part mounting substrate including the thickness of the circuit substrate 20 by using a micrometer manufactured by Mitsutoyo Corp., the thickness for the circuit substrate 20 is subtracted and, as a result, the height of the wire wound electronic part 10 above the mounting land 20 is 1.122 mm for the minimum value, 1.151 mm for the maximum value, and 0.029 mm for the fluctuation range. Further, disturbance in the attitude of the wire wound electronic part 10 accompanying the generation of difference of the height between a pair of terminal electrodes 16A, 16B of the wire wound electronic part 10 was not observed as a result of the visual inspection for the appearance.

Comparative Example

Wire wound electronic parts 110 of the structure described in the existent technique are prepared by the number of 100 in the same manner as described above and, as a result of measuring the maximum lateral size 116W for the terminal electrodes respectively in the same manner as described above, the minimum value is 0.79 mm, the maximum value is 0.93 mm, and the fluctuation range is 0.14 mm.

Further, as a result of mounting the wire wound electronic parts 110 of the comparative example on the circuit substrate in the same manner as the example of certain embodiments, and measuring the height of the obtained wire wound electronic parts on the wire wound electronic part mounting circuit substrate, the minimum value is 1.08 mm, the maximum value is 1.25 mm, and the fluctuation range is 0.22 mm. Further, as a result of observing the attitude of the wire wound electronic parts of the comparative example in the same manner as described above, disturbance of the attitude that the wire wound electronic part is tilted on the circuit substrate is observed for several number of them.

The foregoing embodiments are suitable to the wire wound electronic part used for mobile type electronic equipments or thin electronic equipments.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A wire wound electronic part comprising:

a columnar core with flanges formed at upper and lower ends thereof respectively;

a coil conductor wound around the core; and two terminal electrodes formed at a bottom of a flange, in which both ends of the coil conductor wound around the wire wound core are conductively connected to the terminal electrodes by solder, wherein the two terminal electrodes are contained in two grooves, respectively, formed at the bottom of the flange, wherein each groove is defined by a bottom surface, two side walls opposite to each other disposed on respective lateral sides of the bottom surface apart from the bottom surface, and two moderate slope surfaces connecting the bottom surface and the respective two side walls, said side walls being slanted relative to the bottom of the flange and, when assuming each side wall as a hypotenuse of a right triangle and defining the same with a length for the bottom and the height in the vertical direction (vertical height) of the right triangle, the vertical height of the side wall is formed larger than the length for the bottom and smaller than the diameter at the end of the coil conductor, said moderate slope surfaces being slanted relative to the bottom of the flange and, when assuming each moderate slope surface as a hypotenuse of a right triangle and defining the same with a length for the bottom and the height in the vertical direction (vertical height) of the right triangle, the length for the bottom of the moderate slope surface is formed larger than the vertical height of the moderate slope surface, wherein the edge portions of the terminal electrodes in the lateral direction are restricted by the respective side walls of the grooves, and the grooves are filled with the solder.

2. The wire wound electronic part according to claim 1, wherein the vertical height of the side wall is larger than the thickness of the terminal electrode.

3. The wire wound electronic part according to claim 1, wherein the length for the bottom of the side wall is smaller than the diameter at the end of the coil conductor.

4. The wire wound electronic part according to claim 1, wherein the terminal electrode is a thick film electrode formed by a transfer method.

5. The wire wound electronic part according to claim 1, wherein the thickness of the terminal electrode is substantially constant along the moderate slope surfaces.

6. The wire wound electronic part according to claim 1, wherein the angle of the hypotenuse of the right triangle defining each side wall is the same, and the angle of the hypotenuse of the right triangle defining each moderate slope surface is the same.

* * * * *